US006888524B2

(12) United States Patent
Bayrle et al.

(10) Patent No.: US 6,888,524 B2
(45) Date of Patent: May 3, 2005

(54) LIQUID CRYSTAL DISPLAY DEVICE

(75) Inventors: Reiner Bayrle, Langenau (DE); Thomas Bitter, Ditzenbach (DE); Otto Bader, Warthausen (DE)

(73) Assignee: AEG Gesellschaft fur Moderne Informationssysteme mbH, Ulm (DE)

( * ) Notice: Subject to any disclaimer, the term of this patent is extended or adjusted under 35 U.S.C. 154(b) by 254 days.

(21) Appl. No.: 09/790,999

(22) Filed: Feb. 22, 2001

(65) Prior Publication Data

US 2002/0026734 A1 Mar. 7, 2002

(30) Foreign Application Priority Data

Feb. 24, 2000 (DE) ..... 200 03 356
May 12, 2000 (DE) ..... 100 23 378

(51) Int. Cl.[7] ..... G09G 3/36
(52) U.S. Cl. ..... 345/88; 345/98
(58) Field of Search ..... 345/88, 98, 32; 349/5.96; 340/815.4

(56) References Cited

U.S. PATENT DOCUMENTS

| | | | | |
|---|---|---|---|---|
| 4,791,417 A | | 12/1988 | Bobak | |
| 5,056,893 A | | 10/1991 | Holz et al. | |
| 5,337,068 A | * | 8/1994 | Stewart et al. | 345/88 |
| 5,668,569 A | | 9/1997 | Greene et al. | |
| 5,686,979 A | * | 11/1997 | Weber et al. | 349/96 |
| 5,801,797 A | | 9/1998 | Iida et al. | |
| 5,851,411 A | | 12/1998 | An et al. | |
| 5,867,140 A | * | 2/1999 | Rader | 345/98 |
| 5,867,236 A | | 2/1999 | Babuka et al. | |
| 5,903,328 A | | 5/1999 | Greene et al. | |
| 5,963,276 A | * | 10/1999 | Inbar | 349/5 |
| 6,243,055 B1 | * | 6/2001 | Fergason | 345/32 |
| 6,265,984 B1 | * | 7/2001 | Molinaroli | 340/815.4 |

FOREIGN PATENT DOCUMENTS

| | | |
|---|---|---|
| EP | 0389744 B1 | 1/1990 |
| EP | 0886259 A1 | 12/1998 |
| JP | 03264921 | 11/1991 |
| JP | 04149590 | 5/1992 |
| WO | WO 9828731 A | 7/1998 |
| WO | WO 9949503 | 9/1999 |

OTHER PUBLICATIONS

Sai Yu et al, How Fill Factor Affects Display Image Quality, 1998, SID, entire document.*
EPO Examination Report regarding Application No. 01 104 194.4, dated Aug 24, 2004.
Article, "Alphanumeric and Matrix Panel Systems and Equipment", "Graphics Matrix Panel Systems", pp. 496–497 and preface; A Wiley–Interscience publication, © 1993.
European Search Report dated Nov. 18, 2003.
Japanese Patent Abstract, Application No. JP19900062795, Application Date Mar. 15, 1990, Publication No. 3264921, Publication Date Nov. 26, 1991, European Patent Office.
Japanese Patent Abstract, Application No. JP19900273259, Application Date Oct. 15, 1990, Publication No. 4149590, Publication Date May, 22, 1992, European Patent Office.
English language abstract for EP 0 886 259 A1 from esp@cenet.com.
European Search Report dated Sep. 23, 2002 with English translation.

* cited by examiner

*Primary Examiner*—Dennis-Doon Chow
*Assistant Examiner*—Srilakshmi K. Kumar
(74) *Attorney, Agent, or Firm*—Dority & Manning, P.A.

(57) ABSTRACT

A liquid crystal display device is provided. The liquid crystal display device has a display surface, a sensing device for sensing a light source around the display surface, a control circuit responsive to the sensed light source to adjust a voltage to a controller, which adjusts a transmissivity of the display surface in response to the adjusted voltage.

22 Claims, 4 Drawing Sheets

$$\eta = \frac{\Sigma F_i}{F}$$

$$\eta = \frac{\Sigma F_i}{F}$$

LIQUID CRYSTAL DISPLAY DEVICE

FIELD OF THE INVENTION

The invention relates generally to a Liquid Crystal Display (LCD) having a regulated voltage. More specifically, the invention concerns an LCD-pixel-matrix element, a display screen capable of graphics with a plurality of such LCD-pixel-matrix elements and a procedure for brightness control of such an LCD-pixel-matrix element or such a display screen.

BACKGROUND OF THE INVENTION

For instance, railroad practices make it desirable to have display screens with large surfaces capable of graphics in order to provide to the railroad customers and passengers definite information regarding departure times, placement of cars, location of the diner car, arrival time and the like. Such displays are presently found in open areas and partially in buildings where the displays are subjected to various lighting conditions and ambient illumination. Under conditions of changing illumination, the contrast of known LCD-pixel-matrix elements undergoes very severe swings of visibility, and thus the legibility is not always assured. European Patent (EP) 0 389 744 discloses such an LCD-pixel-matrix element.

SUMMARY OF THE INVENTION

Thus, the present invention makes available an LCD-pixel-matrix element, a display screen capable of graphics with a plurality of such LCD-pixel-matrix elements and a procedure for brightness regulation, i.e. contrast control, for these components.

The present invention provides for variations in the LCD control voltage to correspond with the ambient brightness. By way of example, the LCD control voltage at a brighter ambient light level can be pushed to increasingly higher levels in order to increase the transmission ability of the LCD display. Accordingly, the display appears brighter and is easier to read at higher ambient illumination. In this way, such a display is particularly well suited for outside use where, because of natural conditions, variations very often occur in the incident brightness.

Alternatively, better legibility may be attained when the ratio of light-active surface to the to entire display area lies between 50 and 87%. Particularly desirable is a ratio in a range between 60 and 85%, which provides a pixel (picture element) density of from two to three pixels per square centimeter. It has been empirically found in the case of an LCD-pixel-matrix within these ranges that the legibility is better than in ratios outside of these limitations.

In accord with an advantageous embodiment of the invention, the display surface is rectangular, and the single pixels are arranged in columns and lines. The connection elements and the integrated circuits of the control are, in these cases, in the upper and the lower edge areas. This arrangement permits a plurality of such LCD-pixel-matrix elements to be placed next to one another in order to create a greater display surface. In accord with another advantageous embodiment of the invention, the pixels are combined in color groups to enable the presentation of information in color.

In accord with yet another advantageous embodiment of the invention, a plurality of LCD-pixel-matrix elements are placed beside or below one another, which makes possible an LCD-screen capable of graphics.

In accord with another advantageous embodiment of the invention, the display screen, i.e., the single LCD-pixel-matrix elements, is protected by a transparent cover, e.g. an overlay. This transparent cover is provided with an anti-glare characteristic such as an anti-reflective coating. A transparent anti-reflective coating, for example, permits more light to reach the LCD-design and additionally, the intensity of the disturbing reflections is diminished. As a result, the brightness and the contrast of the LCD-display become greater.

BRIEF DESCRIPTION OF THE DRAWINGS

Further details, features and advantages of the invention are provided by the following detailed description in combination with the drawings, in which:

FIG. 1A is a front view of an example embodiment of a display screen capable of graphics in accord with the present invention.

The detailed description which follows uses numerical and letter designations to refer to features in the drawings. Like or similar designations in the drawings and description have been used to refer to like or similar parts of the invention.

DETAILED DESCRIPTION OF THE INVENTION

Figure 1B:
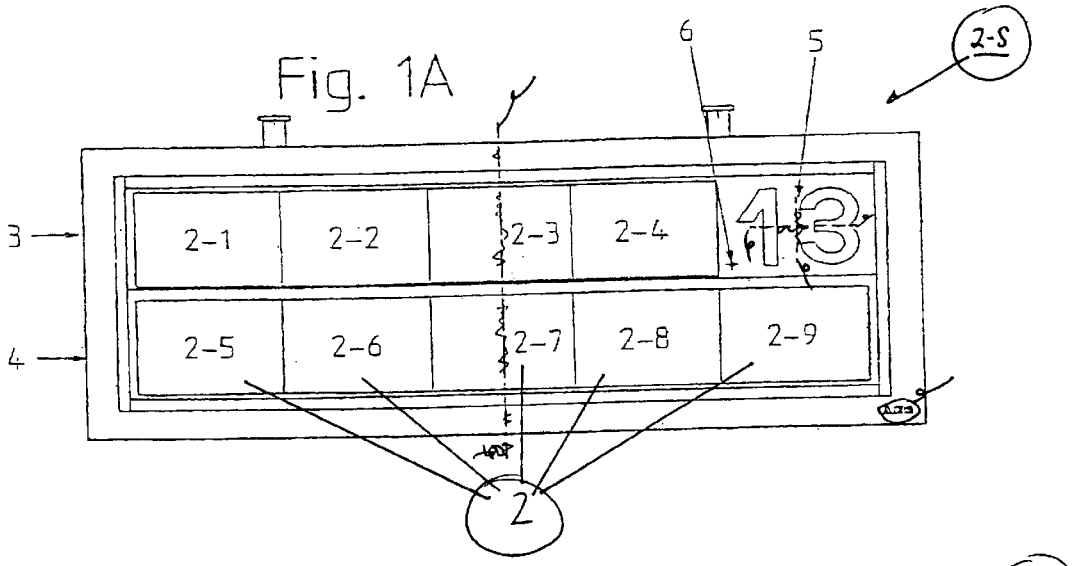
FIG. 1B is a top view of the display screen shown in FIG. 1A.
Figure 1B:
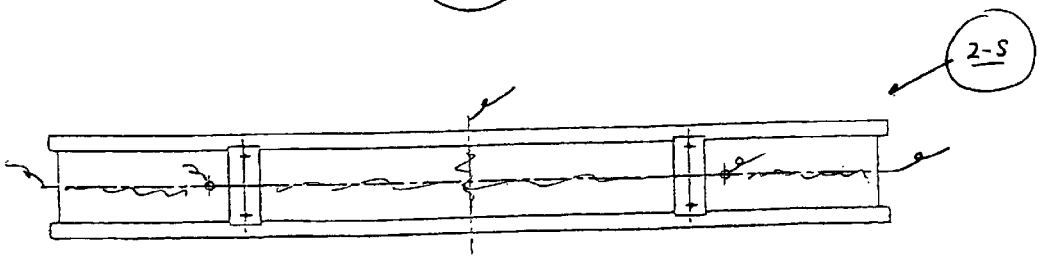

Detailed reference will now be made to the drawings in which examples embodying the present invention are shown. The drawings and detailed description provide a full and detailed written description of the invention, and of the manner and process of making and using it, so as to enable one skilled in the pertinent art to make and use it, as well as the best mode of carrying out the invention. However, the examples set forth in the drawings and detailed description are provided by way of explanation only and are not meant as limitations of the invention. The present invention thus includes any modifications and variations of the following examples as come within the scope of the appended claims and their equivalents.

FIGS. 1A and 1B show, as an example, a screen panel 2-S in accord with the present invention having rows 3 and 4 and five columns of LCD-pixel-matrix elements 2, which are placed adjacent to and above/under one another. In the upper row 3 are four matrix elements 2-1 to 2-4 and in the lower row 4 are located five matrix elements 2-5 to 2-9. The physical outline of the entire screen 2-S mounting is rectangular, and likewise, the pixel-matrix elements are also rectangular.

As shown in FIG. 1A, upper row 3 has, instead of a fifth pixel-matrix element, a free area 5, which is dedicated to a constant printed designation on the display screen 2-S. In this example, a "13" is shown in free area 5 of upper row 3. In this same free area 5 is to be found a light sensing device 6, which assists in automatically adjusting the degree of brightness of the display to the degree of ambient illumination. The pixel-matrix elements 2 are individually of the same size.

It is to be understood that the foregoing example is not intended to limit the present invention to use with only two rows and five columns of rectangularly shaped matrix elements 2. For instance, the invention contemplates various numbers of rows and columns and variously shaped matrix elements 2, such as square or in parallelogram form.

Figure 2:
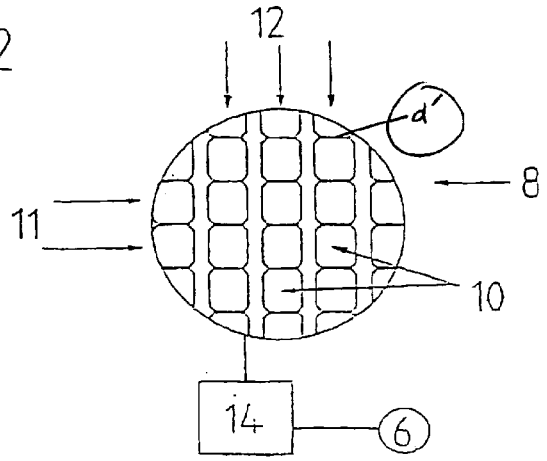
FIG. 2 is a block illustration of the brightness control in accord with the present invention.

FIG. 2 shows schematically a block diagram of a circuit, which controls the brightness of the LCD-pixel-matrix elements 2 to adapt to the surrounding ambient light. Each pixel matrix element 2 possesses one display area 8 in which a plurality of pixels 10 is aligned in rows 11 and columns 12. The signal of brightness level from the light sensor 6 is conducted to a voltage regulator or control circuit 14. The control circuit 14 changes the control voltage $V_{LCD}$ in correspondence with the brightness signal from the sensor 6 to regulate the individual LCD-pixel-matrix elements 2. The control circuit 14 increases the voltage $V_{LCD}$ to correspond to higher values of ambient lighting.

Figure 3:
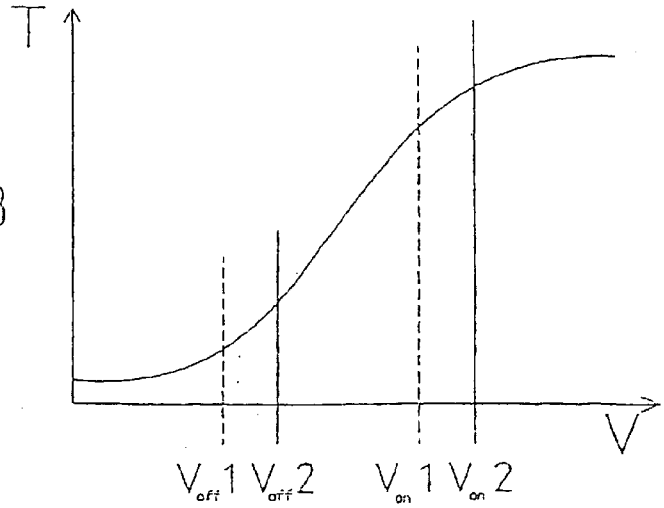
FIG. 3 is a graph representing a brightness curve based on an operation of the invention.

FIG. 3 depicts the foregoing relationship in which the transmissivity T of a pixel 10 (FIG. 2) is expressed as a function of the control voltage $V_{LCD}$. In the case of lower levels of ambient illumination, a control voltage $V_{LCD1}$ results in the paired $V_{off1}$ to $V_{on1}$ for a first level of pixel brightness. Upon higher ambient illumination a control voltage of $V_{LCD2}$ regulates the paired voltages $V_{Off2}$ and $V_{On2}$ resulting in a second level of pixel brightness.

Figure 4:
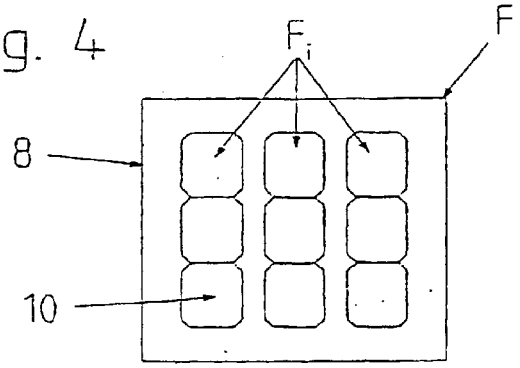
FIG. 4 is a presentation of a filling coefficient of a display surface.

Additionally or alternatively, the legibility of the screen can be influenced by a filling coefficient, expressed as η and the pixel density, i.e., the number of pixels per unit area of the display surface 8. FIG. 4 shows schematically the definition of the filling coefficient η as a quotient of the sum of the surfaces $F_i$ of the individual pixels 10 and the entire area F of the display surface 8 of a pixel-matrix element 2. It has been empirically determined that with a filling coefficient η in a range between 40 and 95%, preferably in a range between 50 and 87%, and especially advantageous in the range between 60 and 85%, and with a pixel density of 2 to 30 pixels per square centimeter, a very good readability is achieved for the display. Additionally, these values permit sufficient space for wiring (not shown).

Figures 5A, 5B:
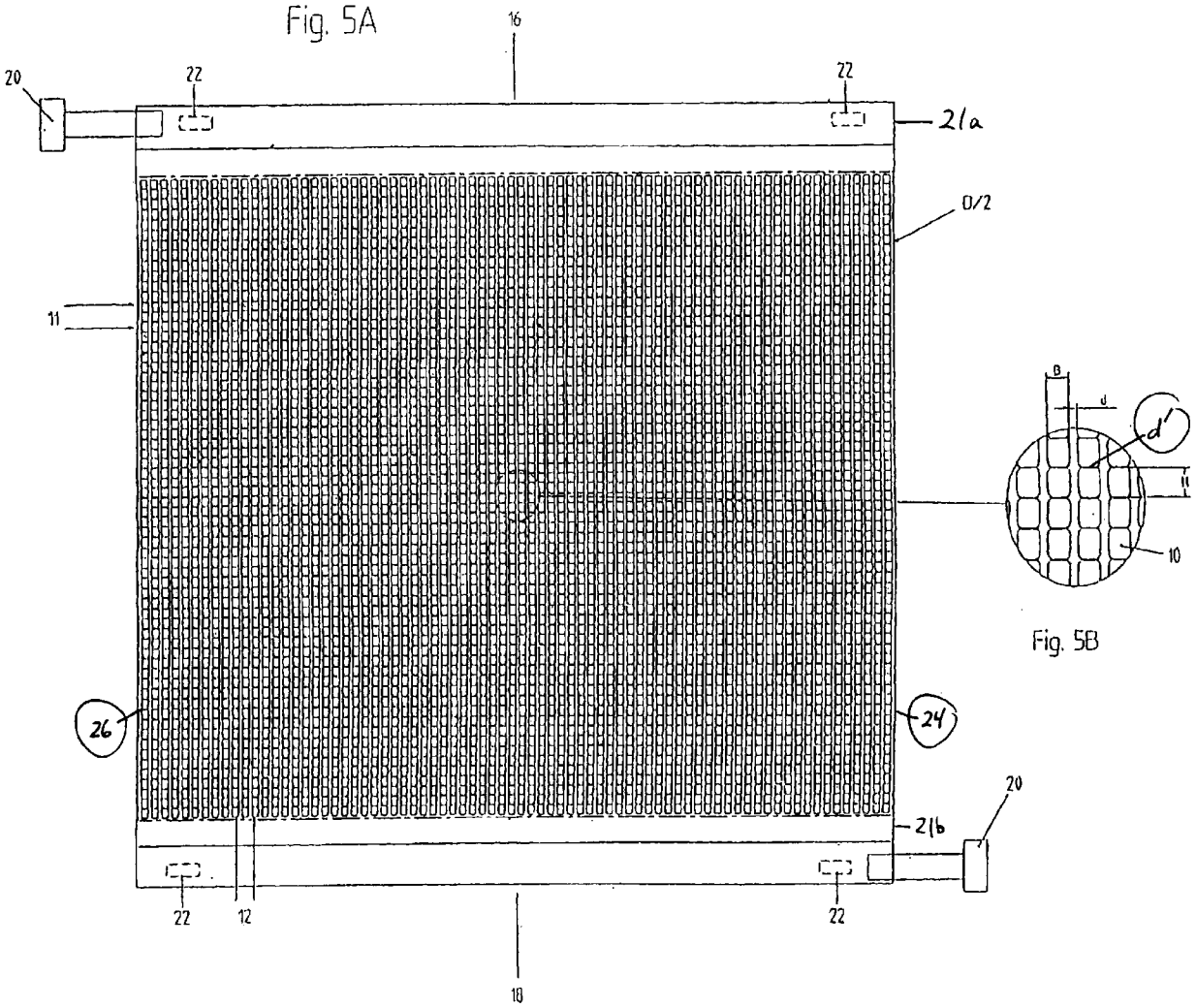
FIG. 5A is a schematic presentation of an LCD-pixel-matrix element.
FIG. 5B is an enlargement of a portion of FIG. 5A.

FIGS. 5A and 5B demonstrate an embodiment of the pixel-matrix element 2 with a plurality of pixels 10, which are aligned in rows 11 and columns 12. In this example, the shape of a single pixel 10 is a rounded off rectangle. On the upper and the lower edge 16, 18 of the pixel-matrix element 2 are connecting elements 20 which bind the individual pixel elements 2 together. Additionally, in the upper and lower edges 21*a*, 21*b*, wiring circuits 22 are provided. The control voltage $V_{LCD}$ is conducted to the wiring circuits 22 by multiplex connections to control the single pixel 10. The multiplex control apparatus 22 is activated by the LCD-control voltage ($V_{LCD}$) to regulate individual pixels 10 with a voltage between a maximum and a minimum value to effect a maximum and minimum transmissivity of the pixels 10.

As may be inferred from FIG. 5B, the individual pixels 10 possess a breadth B and a height H. In this example, the height H is somewhat greater than breadth B. A distance d' between two pixel rows 11 is very minute and serves mainly for the insulation of the directly adjacent pixel 10' seen most clearly in FIG. 2. The distance of the pixel 10 in two neighboring columns 12 is somewhat larger than d' and is designated with a d. The distance d does not serve for the insulation of the pixels 10 from each other. In space d, the connection of the wiring (not shown) to the individual pixels 10 is led from the multiplex circuits 22. Between the pixels 10 of the two outermost pixel divisions on the right and left rims 24, 26 of the pixel-matrix element 2, there remains an edge-width of D/2.

Figures 6A, 6B:
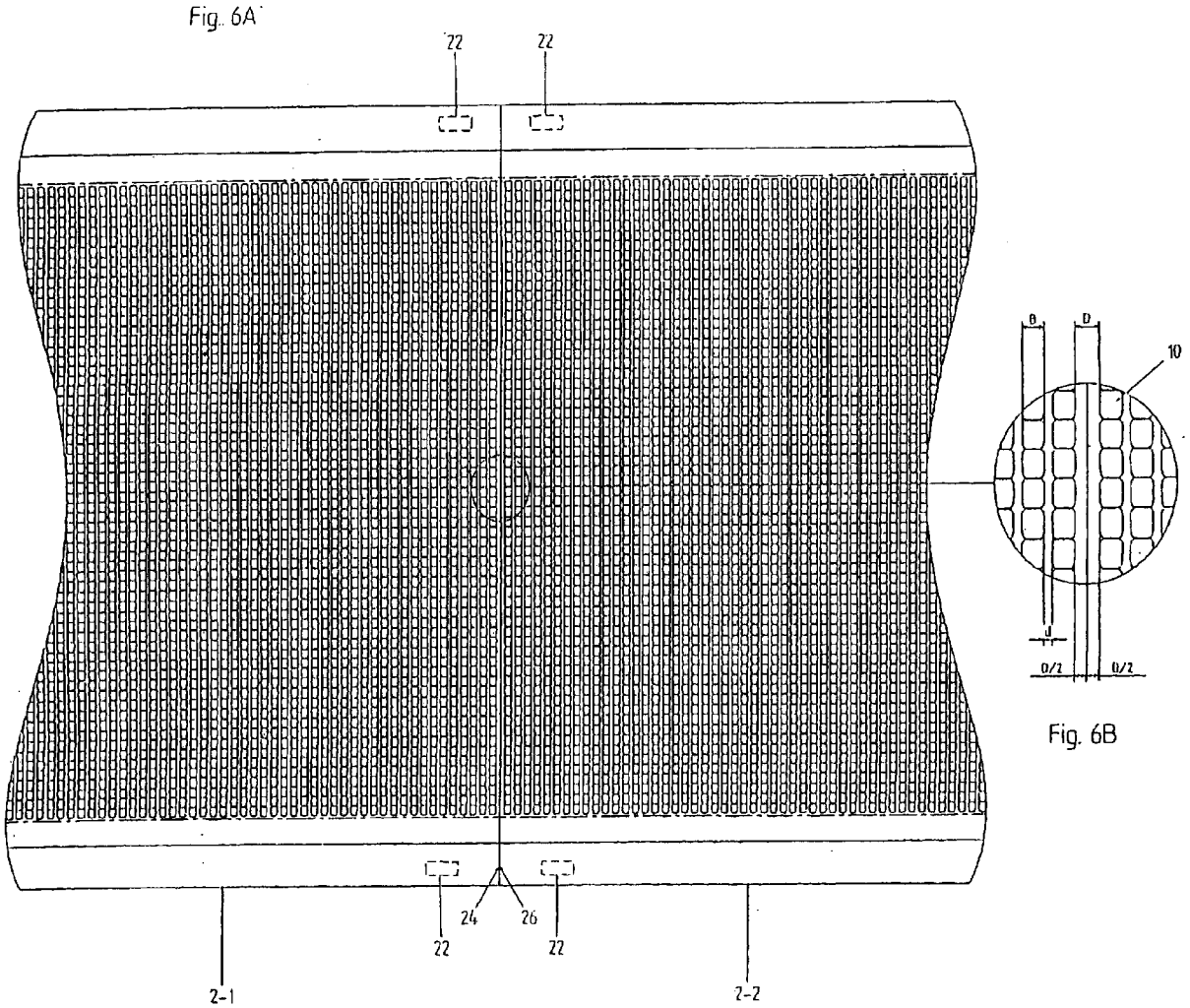
FIG. 6A is a partial schematic presentation of two adjacent LCD-pixel-matrix elements.
FIG. 6B is a detailed enlargement of an adjacent area of FIG. 6A.

FIGS. 6A and 6B show two pixel-matrix elements 2-1 and 2-2, which are set alongside of one another. In this case, the side edges 24, 26 of elements 2-1, 2-2, respectively abut against one another. The directly neighboring pixel divisions on the two adjacent pixel matrix element 2-1 and 2-2 then lie at a distance D one from the other, respectively D/2 on both matrix-elements 2-1, 2-2. This distance D at maximum is equal to the doubled offset d and the pixel breadth B. Stated alternatively, the distance D is smaller or equal to an empty space which arises when a pixel column 12 is omitted from a pixel-matrix element 2. In this manner, there arises an equal-shaped optical impression when two pixel matrix elements 2 are placed beside one another such that the overall visual effect is undisturbed.

It will be apparent to those skilled in the art that various modifications and variations can be made in the present invention without departing from the scope and spirit of the invention. For example, specific shapes of various elements of the illustrated embodiments may be altered to suit particular kiosk or location applications. It is intended that the present invention include such modifications and variations as come within the scope of the appended claims and their equivalents.

What is claimed is:

1. A liquid crystal display device responsive to a light source, comprising:

a display surface having an optically active surface and an inactive surface, the optically active surface including a plurality of pixels cooperable to provide an adjustable transmissivity, the inactive surface disposed proximate the plurality of pixels;

a sensing device for sensing a level of light emitted by the light source;

a control circuit in communication with the sensing device, the control circuit configured to regulate a voltage in response to the sensed level of light; and a controller in communication with the control circuit and the display surface, the controller responsive to the regulated voltage to adjust the transmissivity of the display surface according to the sensed level of light;

wherein the plurality of pixels and the inactive surface define a fill coefficient expressed as the ratio:

$$\eta = \frac{\Sigma F_i}{F},$$

wherein η is the fill coefficient, $F_i$ is a first area defined by the plurality of pixels and F is a second area defined by the display surface including the plurality of pixels and the inactive surface.

2. The liquid crystal display device of claim 1, wherein the inactive surface is configured to receive a wire, the wire configured to electrically connect at least the display surface and the controller.

3. The liquid crystal display device of claim 1, wherein η is between 40% and 90%.

4. The liquid crystal display device of claim 1, wherein η is between 50% and 87%.

5. The liquid crystal display device of claim 1, wherein η is between 60% and 85%.

6. The liquid crystal display device of claim 1, wherein the optically active surface has between two and thirty pixels per square centimeter.

7. The liquid crystal display device of claim 1, wherein the voltage is adjustable from between a maximum voltage to a minimum voltage.

8. The liquid crystal display device of claim 7, wherein the transmissivity of the display surface is correspondingly responsive to the maximum and minimum voltages.

9. A liquid crystal display device responsive to a received light, the liquid crystal display device comprising:

a display panel having a plurality of picture elements (pixels);

a sensor on the display panel for sensing a level of the received light; and a regulator in communication with the sensor, the regulator configured for adjusting a voltage in response to the level of sensed received light to thereby adjust a brightness level of the pixels in response to the adjusted voltage;

wherein the plurality of pixels and an inactive surface disposed proximate the pixels define a fill coefficient expressed as the ratio:

$$\eta = \frac{\Sigma F_i}{F},$$

wherein η is the fill coefficient, $F_i$ is a first area defined by the plurality of pixels and F is a second area defined by the plurality of pixels and the inactive surface.

10. The liquid crystal display device of claim 9, wherein the received light is variable ambient light.

11. The liquid crystal display device of claim 9, wherein the plurality of pixels is disposed in grid-like formation on the display panel, the grid-like formation defining a plurality of columns and a plurality of rows.

12. A liquid crystal display device, comprising:

a display screen having at least two picture element (pixel) matrix elements disposed adjacent each other, each of the two pixel matrix elements having a plurality of pixels and an inactive surface disposed proximate the plurality of pixels;

means for adjusting a brightness of a pixel in at least one of the at least two pixel matrix elements;

a light sensor disposed proximate the display screen, the light sensor configured to sense a light level and communicate the sensed light level to the means for adjusting, the means for adjusting operating responsive to the light to adjust the brightness of the picture element;

wherein each of the respective plurality of pixels and inactive surfaces define a fill coefficient expressed as the ratio:

$$\eta = \frac{\Sigma F_i}{F},$$

wherein η is the fill coefficient, $F_i$ is a first area defined by the plurality of pixels and F is a second area defined by the plurality of pixels and the inactive surface.

13. The liquid crystal display device of claim 12, wherein the at least two pixel matrix elements are disposed adjacent each other according to an expression:

$D \leqq B+2d$ wherein,

D is a distance between the at least two pixel matrix elements, B is a breadth of a pixel in a column of pixels in the at least two pixel matrix elements, and d is a distance between the column of pixels and an adjacently disposed second column of pixels, the at least two pixel matrix elements configured to produce graphics.

14. The liquid crystal display device of claim 12, wherein the means for adjusting has a multiplexing circuit disposed on an edge area of the display screen, the multiplexing circuit in communication with the pixel and responsive to a signal from the means for adjusting to adjust the pixel.

15. The liquid crystal display device of claim 12, wherein the at least two pixel matrix elements each define a first edge area and a second edge area, the first edge areas overlappingly disposed adjacent each other, the liquid crystal display device further including at least a third pixel matrix element abuttingly disposed adjacent at least one of the second edge areas of the at least two pixel matrix elements.

16. An LCD-pixel-matrix element having a display area including a plurality of optically active surfaces and a plurality of non-optically active surfaces, the non-optically active surfaces configured to establish an electrical communication between at least two of the optically active surfaces, the optically active surfaces being a plurality of pixels, wherein the pixels and the non-optically active surfaces define a fill coefficient expressed as a ratio:

$$\eta = \frac{\Sigma F_i}{F},$$

wherein η is the fill coefficient, $F_i$ is the pixels, and F is the pixels and the non-optically active surfaces, and wherein the ratio is between about 40% to about 90% and $F_i$ defines a pixel density of about 2 to 30 pixels/cm$^2$.

17. The LCD-pixel-matrix element as in claim 16, wherein the ratio is between about 50% to about 87%.

18. The LCD-pixel-matrix element as in claim 16, wherein the ratio is between about 60% and to about 85%.

19. The LCD-pixel-matrix element as in claim 16, further comprising:

a sensing device for sensing a level of light emitted by a light source;

a control circuit in communication with the sensing device, the control circuit configured to regulate a voltage in response to the sensed level of light; and a controller in communication with the control circuit and the display area, the controller responsive to the regulated voltage to adjust the transmissivity of the display area according to the sensed level of light.

20. The LCD-pixel-matrix element as in claim 16, wherein the LCD-pixel-matrix element is at least two adjacent LCD-pixel-matrix elements forming adjacent pixel columns disposed apart from each other by a distance defined by the equation:

$D \leqq B+2d$, wherein

D is the distance between the at least two LCD-pixel-matrix elements, B is a breadth of a pixel in one of the pixel columns, and d is a distance between the column of pixels and an adjacently disposed second column of pixels, the at least two adjacent LCD-pixel-matrix elements configured to produce graphics.

21. An LCD-display panel having a plurality of LCD-pixel-matrix elements configured for graphic exhibition, the LCD-pixel-matrix elements disposed adjacent each other, the LCD display panel comprising:

a connection element and a control circuit disposed in an upper edge area and a lower edge area of each of the LCD-pixel-matrix elements, wherein two adjacent LCD-pixel-matrix elements form adjacent pixel columns disposed apart from each other by a distance defined by the equation:

$D \leqq B+2d$, wherein

D is the distance between the at least two LCD-pixel-matrix elements, B is a breadth of a pixel in one of the pixel columns, and d is a distance between the column of pixels and an adjacently disposed second column of pixels, the at least two pixel matrix elements configured to produce graphics in a display area defining a pixel density of about 2 to 30 pixel/$cm^2$.

22. The LCD-display panel as in claim 21, further comprising:

a sensing device for sensing a level of light emitted by a light source;

a control circuit in communication with the sensing device, the control circuit configured to regulate a voltage in response to the sensed level of light; and a controller in communication with the control circuit and the display area, the controller responsive to the regulated voltage to adjust the transmissivity of the display area according to the sensed level of light.

* * * * *

UNITED STATES PATENT AND TRADEMARK OFFICE

CERTIFICATE OF CORRECTION

PATENT NO. : 6,888,524 B2
DATED : May 3, 2005
INVENTOR(S) : Bayrle et al.

It is certified that error appears in the above-identified patent and that said Letters Patent is hereby corrected as shown below:

Title page,
Item [56], References Cited, OTHER PUBLICATIONS, please correct "Japanese Patent Abstract Application No. JP19900062795" to read -- Japanese Patent Abstract Application No. JP19900062759 --.

Signed and Sealed this

Fourth Day of October, 2005

JON W. DUDAS
*Director of the United States Patent and Trademark Office*